United States Patent [19]

Hakiel

[11] Patent Number: 4,934,622

[45] Date of Patent: Jun. 19, 1990

[54] CORE FOR WINDING A WEB OF DEFORMABLE MATERIAL

[75] Inventor: Zbigniew Hakiel, Webster, N.Y.

[73] Assignee: Eastman Kodak Company, Rochester, N.Y.

[21] Appl. No.: 336,165

[22] Filed: Apr. 11, 1989

[51] Int. Cl.[5] ..... B65H 75/18

[52] U.S. Cl. ..... 242/68.5; 242/1

[58] Field of Search ..... 242/68, 68.4, 68.5, 242/68.6, 74, 118.32, 1, 118.2, 118.31

[56] References Cited

U.S. PATENT DOCUMENTS

| | | | |
|---|---|---|---|
| 973,923 | 10/1910 | Donnelly | 242/68.6 |
| 1,857,519 | 5/1932 | Spry | 242/68.5 X |
| 2,917,251 | 12/1959 | Newburger | 242/74 |
| 2,953,313 | 9/1960 | Csutor | 242/68.5 |
| 2,953,316 | 9/1920 | Henry | 242/118.7 |
| 3,297,155 | 1/1967 | Gattenby, Jr. et al. | 242/68.5 |
| 3,737,030 | 6/1973 | Stewart | 206/59 |
| 4,697,757 | 10/1987 | Nakaya et al. | 242/68.5 |
| 4,832,276 | 5/1989 | Gebhardt et al. | 242/68.5 X |

FOREIGN PATENT DOCUMENTS

| | | | |
|---|---|---|---|
| 862550 | 1/1953 | Fed. Rep. of Germany | 242/74 |
| 3610557 | 3/1986 | Fed. Rep. of Germany . | |
| 1440515 | 6/1976 | United Kingdom | 242/68 |

*Primary Examiner*—Stanley N. Gilreath
*Attorney, Agent, or Firm*—John B. Turner

[57] ABSTRACT

A core for winding a web of deformable material, such as photographic film base, which has knurlings along its margins. The core includes a rigid cylindrical member with a sleeve of resilient material. The sleeve has a cylindrical outer surface and has a length less than the distance between the margins containing the knurlings. There are means contiguous with the ends of the sleeves for providing cylindrical surfaces having diameters substantially equal to that of the sleeve. These means underlie the knurlings in the web when the web is wound on the core and may take the form of resilient material which is harder than the sleeve, or they may be rigid. In the latter case the surface-providing means may be integral with the rigid cylindrical member.

4 Claims, 1 Drawing Sheet

CORE FOR WINDING A WEB OF DEFORMABLE MATERIAL

BACKGROUND OF THE INVENTION

1. Field of the Invention

This invention relates to cores for winding webs of deformable materials.

2. Description of the Prior Art

Published German Patent Application (Offenlegungsschrift) No. 3,610,557 describes cores for winding webs of paper. That specification describes the known problem that if the core is rigid, the adhesive tape which is used to secure the leading edge of the web of paper to the core will cause, by virtue of the finite thickness of the adhesive tape, an embossing of the paper for many turns of the paper on the core. This embossing occurs by virtue of the high radial pressure which builds up as successive turns are wound on the core. The leading edge of the web also causes such embossings. Paper which contains such embossings is, for many purposes, useless, and hence the end portion of the web, perhaps as much as several hundred feet, has to be discarded.

Offenlegungsschrift No. 3,610,557 describes a solution to the problem of embossings caused by the adhesive tape and the end edge of the web, and like irregularities. That described solution is to provide the core with a coating of elastically or plastically deformable material which deforms to accommodate the irregularity so that the first turns of the web on the core do not have to deform to accommodate the irregularity.

In the manufacture of webs of base material for photographic film, the problems which derive from lack of uniformity in thickness (often called "gage") across the web, are well known. One such problem derived from gage non-uniformity, is known as gage bands. If the region of increased thickness is at a constant position, considered laterally of the web, when the web is wound on a core, the increased thickness region of each turn will lie on top of the increased thickness region off the previous turn and what is known to those skilled in the art as a gage band, results. In the gage band there is localized very high pressure which often results in undesirable effects such as abrasion, deformation and chemical and/or physical changes. To overcome the problems of gage bands, it is known to knurl the margins of the web of base material so that the protuberances produced by the knurling are higher than any gage increase likely to be encountered in normal manufacturing. When the web with the knurling along its two margins is wound on a conventional rigid core having a non-flexible surface, the knurlings in the two margins wind on top of themselves and it is in those areas, rather than where the gage increases overlie one another, that the high pressure between adjacent turns is encountered. Prior to use in the production of film, the margins containing the knurlings are slit off and discarded and it may be safely assumed that the entire portion of the web between the margins is free from any defects attributable to gage bands.

It has been found that when a web of photographic base material, having knurlings along its margins, is wound on a core such as is described in Offenlegungsschrift No. 3,610,557, if the coating on the core is soft enough to avoid undesirable embossings in the web due to the end edge or the securing tape, the very high pressures progressively created by the knurlings stacked upon themselves cause the wound web to collapse radially inwards. Such collapses are, inevitably, not localized, considered in the direction axially of the roll, but extend along the roll axially from the margins towards the middle of the width of the roll. The collapses cause permanent damage to the web and, hence, the width of web at the margins which has to be slit off and discarded, is increased. This results in undesirably increased waste and correspondingly lower productivity.

OBJECT OF THE PRESENT INVENTION

It is an object of the present invention to gain the advantage of avoiding embossings in the first turns of a web of photographic film base material wound on a core and having knurlings in its margins, by having a layer of resilient material at the exterior of the core, but also to avoid the collapse of the wound on web at and axially inwards from the knurled margins of the web.

SUMMARY OF THE INVENTION

The object is achieved in accordance with the present invention by a core having a rigid cylindrical member and a resilient sleeve on the rigid cylindrical member. The sleeve has a cylindrical surface and a length less than the known distance between the margins of the web to be wound on the core. Also, there are means, contiguous with the ends of the sleeve, for providing cylindrical surfaces having diameters substantially equal to that of the sleeve. The cylindrical surfaces providing means underlie the margins of the web and are harder than the sleeve. Because the means providing the cylindrical surfaces onto which the knurled margins of the web are wound are harder than the sleeve, they do not allow the margins to collapse under the great pressures which build up with successive turns of the web on the core. At the same time, embossings due to the adhesive tape securing the leading end of the web to the core and due to the end edge of the web against the core, are avoided by virtue of the relatively soft sleeve which accommodates the irregularities.

The means providing the cylindrical surfaces at the ends of the resilient sleeve may be rigid or resilient.

If the means providing the cylindrical surfaces at the ends of the resilient sleeve are rigid they may conveniently be formed by undercutting the rigid cylindrical member to a depth such that the resilient sleeve fits in the undercut.

If the means providing the cylindrical surfaces are themselves resilient, they may be formed by second and third sleeves which are also resilient but are harder than the first sleeve.

BRIEF DESCRIPTION OF THE DRAWINGS

Embodiments of the present invention will now be described, by way of example, with reference being made to the accompanying drawings, in which.

DESCRIPTION OF THE PREFERRED EMBODIMENTS

Figure 1:
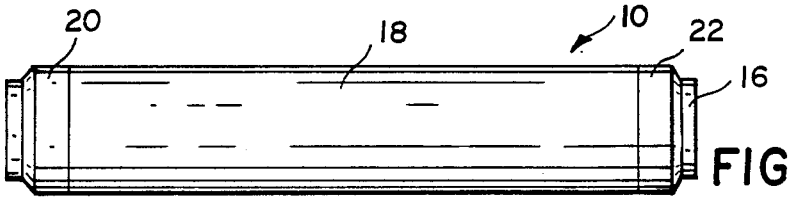
FIG. 1 is a side view of a core in accordance with a first embodiment of the present invention.
Figure 2:
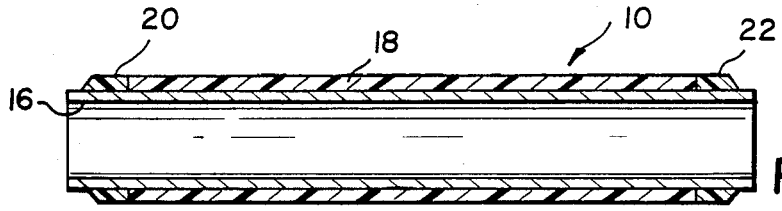
FIG. 2 is a sectional view in a plane containing the axis, of the core illustrated in FIG. 1.

In FIGS. 1 to 4 of the accompanying drawings there is illustrated a core 10 for winding a web 12 of flexible deformable material which, in the present embodiment, is cellulose triacetate photographic film base. In its margins the web 12 has knurlings 14 which, in effect, increase the maximum thickness of the web 12. The distance d1 between the margins containing the knurlings is known and is uniform throughout the length of the web 12.

The core 10 includes a rigid cylindrical member 16 formed of metal. In the present embodiment, the external surface of the member 16 is cylindrical. The member 16 has cast on it first, second and third sleeves 18, 20, and 22, respectively. The second and third sleeves 20 and 22 are contiguous with the first sleeve 18 and the surfaces of all three sleeves conform to a common cylinder which is coaxial with the cylindrical member 16. The second and third sleeves 20 and 22 constitute means, contiguous with the ends of the first sleeve 18, for providing cylindrical surfaces having diameters substantially equal to that of the cylindrical surface of the first sleeve 18 and they are intended to underlie the margins of the web 12. For this purpose, the length d2 of the first sleeve is less than the distance d1 between the margins containing the knurlings 14.

The three sleeves 18, 20, 22 are all formed of elastomeric material which in the present example is polyurethane. However, the second and third sleeves 20, 22 are harder than the first sleeve 18. The first sleeve 18 has a 20 to 40 Shore A value and the second and third sleeves 20 and 22 have a 50 to 70 Shore A value. The thickness of the sleeves is typically ⅛ to ½ in. and the axial length of the full thickness portion of the second and third sleeves 20, 22 is in the 1 to 3 in. range. The actual length of the full thickness portion of the second and third sleeves 20, 22 depends on the accuracy with which the web 12 is positioned laterally on the core and, of course, on the width of the knurlings. It is important that the knurlings 14 lie over the second and third sleeves 20, 22. One example of a core for winding cellulose triacetate photographic film base has an external diameter of 6 inches.

Figure 3:
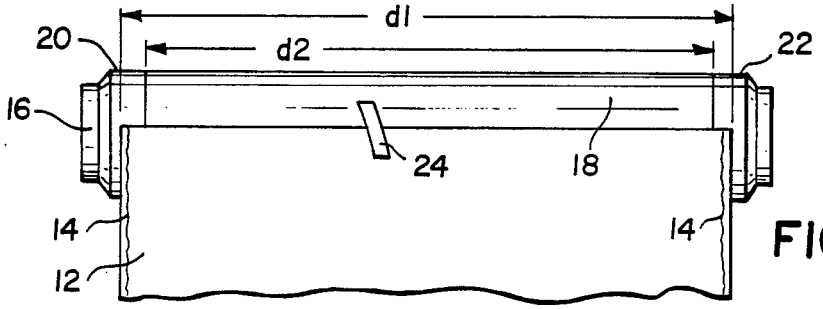
FIG. 3 is a plan view of the core illustrated in FIGS. 1 and 2 with the leading edge of a web of photographic film base secured thereto at the beginning of winding the web onto the core.
Figure 4:
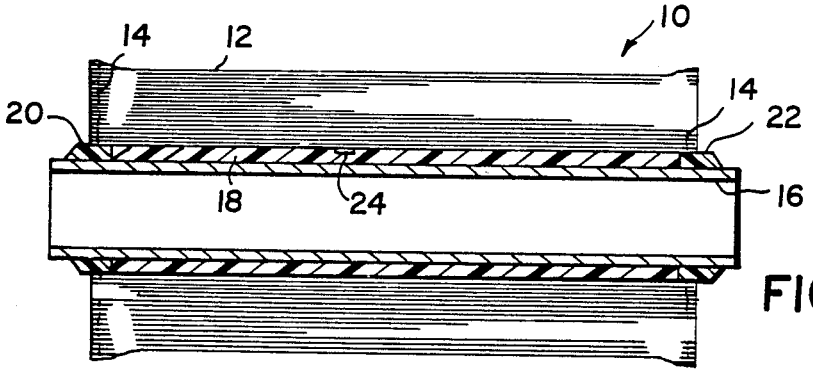
FIG. 4 is a sectional view similar to that of FIG. 2 but with a web wound onto the core.

FIG. 3 illustrates a piece 24 of adhesive tape which secures the leading end of the web 12 to the core 10. The tape piece 24 has finite thickness, as can be seen in FIG. 4. The web 12 itself also has thickness. Hence, where the web, at the beginning of the second turn, overlies the tape and steps up over the leading end of the web, the effective diameter presented to the web tends to take a sharp increase. This is even greater where the tape piece 24 overlies the leading edge of the web. If the first sleeve were not deformable, these sharp effective diameter increases would cause embossings into the second, and successive, turns of the web as they are wound on and as the pressure increases with each successive turn. However, because the first sleeve is deformable, the sharp step caused by the leading edge of the web is smoothed out into a ramp because the leading end margin of the web at least partially buries into the first sleeve. Likewise, the tape piece 24 at least partially buries into the first sleeve so that the web ramps up rather than steps up onto it. Such ramps, as opposed to sharp steps, do not produce intolerable embossings in successive turns of the web. Hence waste is reduced. The stiffness of the material of the first sleeve 18 should be chosen so that the desired effect is achieved and so that collapse of the core under the high pressures which are encountered as the number of turns on the core increase, is avoided. The tightness of the turns, which is a function of the tension in the web as it is wound on the core, determines, in part, the pressures in the wound web.

The greatest pressures in the wound web 12 are encountered in the margins of the roll where the knurlings 14 in the margins of the web 12 overlie one another in successive turns. The pressures get so high in these regions that, if the second and third sleeves 20, 22 were as soft as the first sleeve, they would not be able to oppose collapse of the wound web in some regions. Such collapse is sometimes termed spoking and occurs as one or more corrugations when viewed axially. The stresses occurring in the web in such collapsed regions are so great that there is deformation of the web which is permanent and does not disappear upon unwinding of the web. Thus, the hardness of the second and third sleeves 20, 22 is chosen to be sufficient to prevent the just-described collapse.

The sleeves should be formed of material which from the bulk viewpoint is as incompressible as possible. If it were compressible, there would be a progressive reduction in diameter of the core as the number of turns increased. Such reduction in diameter would result in deformation of the web and a great length of the web would be useless for many purposes. Thus, the material chosen for the sleeves has as high a Poisson's Ratio as is possible. The polyurethane chosen for the sleeves of the present embodiment has a Poisson's Ratio of 0.5.

Figure 5:
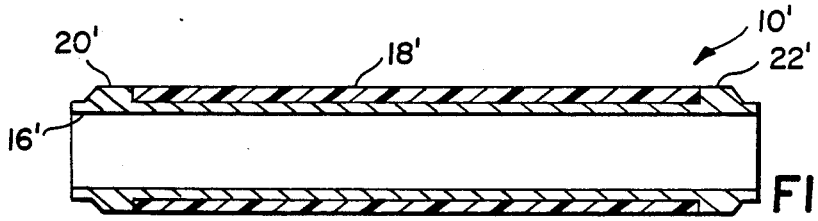
FIG. 5 is a sectional view similar to that of FIG. 2 but of a second embodiment of the present invention.

FIG. 5 illustrates a second embodiment of the present invention. Only those features of the second embodiment will be described which differ in form and/or function from the first embodiment. Parts which correspond to parts in the first embodiment will be given the same reference numerals but with the addition of a prime (') suffix. For an understanding of parts and/or performance of features not specifically described in relation to the second embodiment, reference should be made to the description of the first embodiment.

The core 10' illustrated in FIG. 5 is again rigid and cylindrical and is formed of phenolic resin. The means 20' and 22' contiguous with the ends of the sleeve 18' for providing cylindrical surfaces having diameters substantially equal to that of the cylindrical surface of the sleeve are integral with the rigid cylindrical member 16' and are in the form of integral collars. In fact, the means 20' and 22' may be formed by starting with a thick cylindrical member 16' and undercutting it where the sleeve 18' is to be disposed. The sleeve 18' could then be cast into the undercut. In this embodiment, wherein the means 20' and 22' are formed of the same material as the rigid member 16', the means 20' and 22' are infinitely harder than the sleeve 18'.

The invention has been described in detail with particular reference to a presently preferred embodiment, but it will be understood that variations and modifications can be effected within the spirit and scope of the invention.

What is claimed is:

1. A core for winding a web of deformable material which is knurled along its margins and has a known distance between the margins, said core comprising:

a rigid cylindrical member;

a resilient sleeve supported by said rigid cylindrical member throughout the length of the sleeve, said resilient sleeve having a cylindrical surface and a length less than the known distance between the margins of the web to be wound on the core; and means, contiguous with the ends of said sleeve, for providing cylindrical surfaces having diameters substantially equal to that of the cylindrical surface of said sleeve, for underlying said margins of the web, said means being harder than said sleeve.

2. A core as claimed in claim 1, wherein said means is rigid.

3. A core as claimed in claim 2, wherein said rigid means is integral with said cylindrical member.

4. A core as claimed in claim 1, wherein said means is formed by second and third sleeves of resilient material, the material of said second and third sleeves being harder than the first-mentioned sleeve.

* * * * *